US006354034B1

(12) United States Patent
Norris, Sr.

(10) Patent No.: US 6,354,034 B1
(45) Date of Patent: Mar. 12, 2002

(54) QUICK-DETACHABLE SLING SWIVEL

(75) Inventor: Larry Alfred Norris, Sr., Hillsboro, OR (US)

(73) Assignee: Michaels of Oregon Co., Oregon City, OR (US)

( * ) Notice: Subject to any disclaimer, the term of this patent is extended or adjusted under 35 U.S.C. 154(b) by 0 days.

(21) Appl. No.: 09/437,961

(22) Filed: Nov. 10, 1999

(51) Int. Cl.[7] ..... F41C 23/00
(52) U.S. Cl. ..... 42/85; 224/105
(58) Field of Search ..... 42/85; 224/105

(56) References Cited

U.S. PATENT DOCUMENTS

| | | | | | |
|---|---|---|---|---|---|
| 1,088,314 | A | | 2/1914 | Wilcke | 42/85 |
| 1,309,431 | A | * | 7/1919 | Badger | 24/2.5 |
| 2,078,010 | A | | 4/1937 | Meepos | 42/85 |
| 2,190,268 | A | * | 2/1940 | Magid | 42/85 |
| 2,771,699 | A | | 11/1956 | Herter | 42/85 |
| 3,704,537 | A | | 12/1972 | McKinzie | 42/85 |
| 4,299,343 | A | | 11/1981 | Atchisson | 224/149 |
| 4,454,675 | A | | 6/1984 | Ives | 42/85 |
| 4,505,012 | A | | 3/1985 | Johnson | 42/85 |
| 4,841,658 | A | | 6/1989 | Katsenes | 42/85 |
| 5,067,267 | A | | 11/1991 | Ives | 42/85 |
| 5,074,069 | A | | 12/1991 | Shire | 42/85 |
| 5,279,060 | A | | 1/1994 | Watson | 42/96 |
| 5,433,360 | A | * | 7/1995 | Rock | 224/258 |
| 6,112,448 | A | * | 9/2000 | Gray et al. | 42/94 |
| 6,178,600 | B1 | * | 7/2001 | French | 24/2.5 |

* cited by examiner

*Primary Examiner*—Michael J. Carone
*Assistant Examiner*—Denise J Buckley
(74) *Attorney, Agent, or Firm*—Chernoff, Vilhauer, McClung & Stenzel, LLP

(57) ABSTRACT

A quick-detachable sling swivel comprises a body and a shift/swing gate mounted on the body through an elongated plunger. The gate, through manipulation of the plunger, is adjustable between open and closed positions relative to the body to enable mounting, demounting and securing of the swivel relative to an external structure. The swivel has a locking mechanism for restricting movement of the plunger to prevent the gate from opening. The body and the loop are integrally formed of metal. The loop has a pair of opposed substantially parallel side members. The gate may include a wedge protruding toward the tang, the wedge having an upper surface that, in the closed position, opposes a flat lower surface of the body. The swivel is capable of withstanding at least 500 lbs. of pull force.

23 Claims, 2 Drawing Sheets

QUICK-DETACHABLE SLING SWIVEL

BACKGROUND OF THE INVENTION

The present invention relates to quick-detachable swivels for attaching a sling to a firearm and, in particular, to such swivels that have improved strength to withstand high stress generated by extreme pulling forces.

Quick-detachable swivels have been known in the art for some time. In general, such swivels have a loop at one end of a body for attachment to a sling, and a mounting pin that is receivable by a conventional mounting base or swivel stud attached to a firearm. An example of such a sling swivel is disclosed in Ives, U.S. Pat. No. 4,454,675. While the known sling swivels are functional, there has developed a need for swivels that are capable of withstanding extreme pull forces exerted on the sling. For example, it is desired to develop a swivel that is strong enough to allow a soldier in full gear to be pulled or carried by pulling on the sling attached to his weapon. Such a sling swivel should be capable of withstanding pull forces in excess of 500 pounds. In addition, the sling swivel must retain its quick-detachable capability, and must also be relatively lightweight.

However, such extreme pull forces induce severe stress in several portions of the sling swivel. The primary points of failure for sling swivels are the loop attached to the sling, and the shift/swing gate that prevents the mounting pin from being detached from the mounting base. Because the pull force is initially received by the loop, the loop may become deformed and fail when subjected to extreme pull forces. In addition, because the extreme pull forces may twist the sling swivel and induce torque within the shift/swing gate relative to the mounting pin, the pull forces may cause the shift/swing gate to become detached from the mounting pin and rotate from the closed to the open condition, thereby allowing the mounting pin to slide out of the bore of the swivel stud.

Two examples of sling swivels are disclosed in Ives, U.S. Pat. No. 4,454,675, and Ives, U.S. Pat. No. 5,067,267. In those swivels, the loop is fashioned from a piece of wire having a circular cross section that is bent to form the loop, so that the loop has curved sides. The two ends of the loop are then inserted into the body to attach the loop to the body. When such a swivel is subjected to extreme pull forces, the loop will either deform its shape, or pull completely apart from the body.

Another sling swivel, sold by Boonie Packer of Salem, Oreg., is made from injected molded metal so that the loop portion is integral with the body. However, the Boonie Packer loop has the same curved sides and circular cross-section as the loop of the swivels disclosed in the two Ives patents discussed above. Like those swivels, the loop of the Boonie Packer swivel also deforms when subjected to extreme pull forces.

Yet another sling swivel manufactured by Boonie Packer of Salem, Oreg., is formed by bending a wire having a rectangular cross-section to form a loop having curved outer portions, like that of the Boonie Packer injection molded sling swivel and the swivels disclosed in the two Ives patents. Instead of having a solid body, the two end portions of the wire extend in substantially straight lines away from the loop portion, with the mounting pin extending from one of the end portions. The wire loop of this swivel also fails when subjected to extreme pull forces.

Other sling swivels having a loop integral with the body are also known, but these are formed from plastic materials. An example of such a swivel is Shire U.S. Pat. No. 5,074,069. Such swivels are incapable of withstanding extreme pull forces.

Accordingly, what is still desired is a sling swivel that is quick-detachable, that is capable of withstanding extreme pull forces, that has a loop portion for attaching to a sling but that resists deformation when subjected to extreme pull forces, that has a shift/swing gate that resists opening when subjected to extreme stress, that is relatively light weight, and that is easily and cheaply manufactured.

SUMMARY OF THE INVENTION

The present invention overcomes the aforesaid drawbacks of the prior art and provides an improved quick-detachable sling swivel capable of withstanding extreme pull forces. The quick-detachable sling swivel of the present invention comprises a body having a first end and a tang located oppositely from the first end. The tang supports a mounting pin. A loop is attached to the first end of the body. An elongate plunger is mounted in the body and defines a plunger axis. The plunger is movable axially between first and second positions with respect to the body. A shift/swing gate is associated with the body through the plunger. The gate is rotatable when the plunger is in the second position, and the gate is capable of interconnecting with the tang when the plunger is in the first position. The swivel includes a locking mechanism for locking the plunger positively and selectively against movement from the first to the second position. The body and the loop are an integral member. The loop has a pair of opposed substantially parallel side members.

In another separate aspect of the invention, the gate has a wedge protruding toward the tang, the wedge having an upper surface that, when the gate is interconnected with the tang, opposes a flat lower surface of the body.

In yet another separate aspect of the invention, the swivel is capable of withstanding at least 500 lbs. of pull force.

The various aspects of the invention have one or more of the following advantages. The swivels are capable of withstanding extreme pull forces in excess of 500 lbs. without visible deformation. In particular, the substantially parallel side members of the loop are especially resistant to collapsing inwardly when subjected to extreme pull forces. The opposing surfaces of the gate and body also allow the swivels to resist opening when subjected to extreme stress. In addition, the injection molded metal swivels are also relatively light weight, and are easily and cheaply manufactured.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
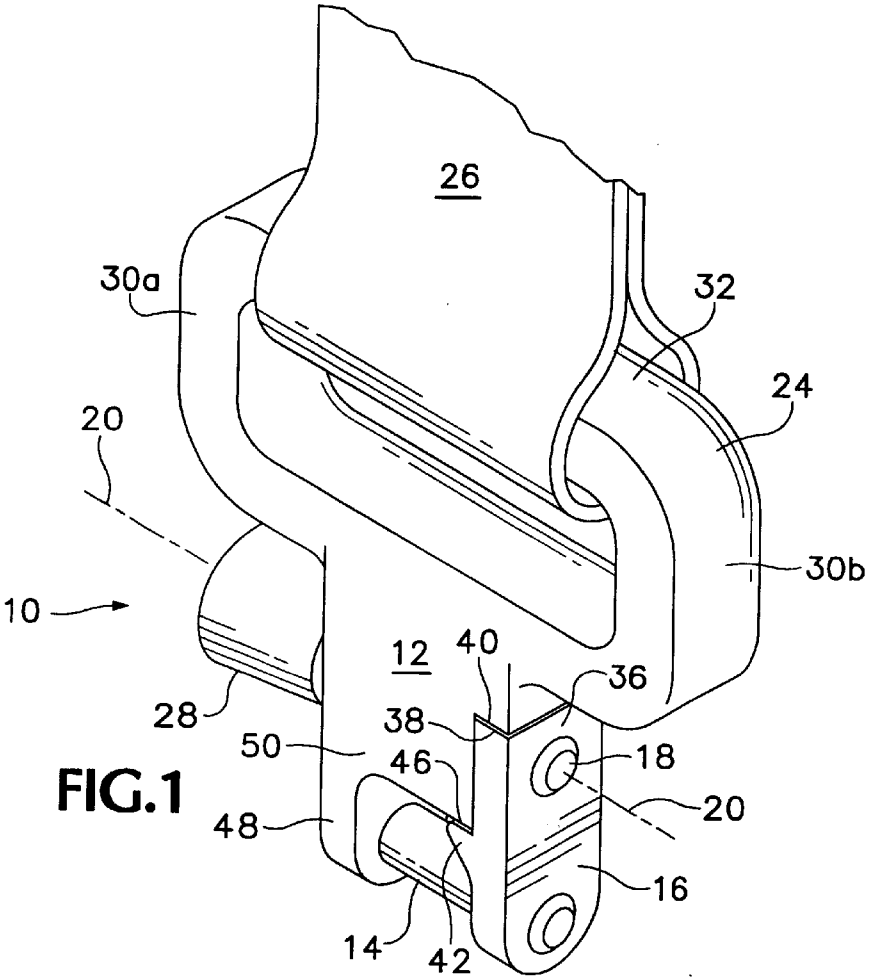
FIG. 1 is a perspective view of an exemplary sling swivel of the present invention attached to a sling, with the sling shown in fragmentary view, and in which the shift/swing gate is in the closed position.

Referring now to the drawings wherein like numerals refer to like elements, FIG. 1 shows a sling swivel 10 that is one embodiment of a locking quick-detachable swivel constructed in accordance with the present invention. In general terms, swivel 10 includes a body 12 which carries a mounting pin 14 that coacts with a shift/swing gate 16. Swivel 10 may be connected to a firearm stock through the use of a conventional mounting base or swivel stud that is attached to the firearm, and which includes a suitable bore that receives mounting pin 14. Body 12 also has a single loop 24 which is shown receiving the reverse bend in an end of a sling 26. The swivel 10 may also be connected to luggage or other items to which a mounting base or swivel stud may be attached.

Figure 2:
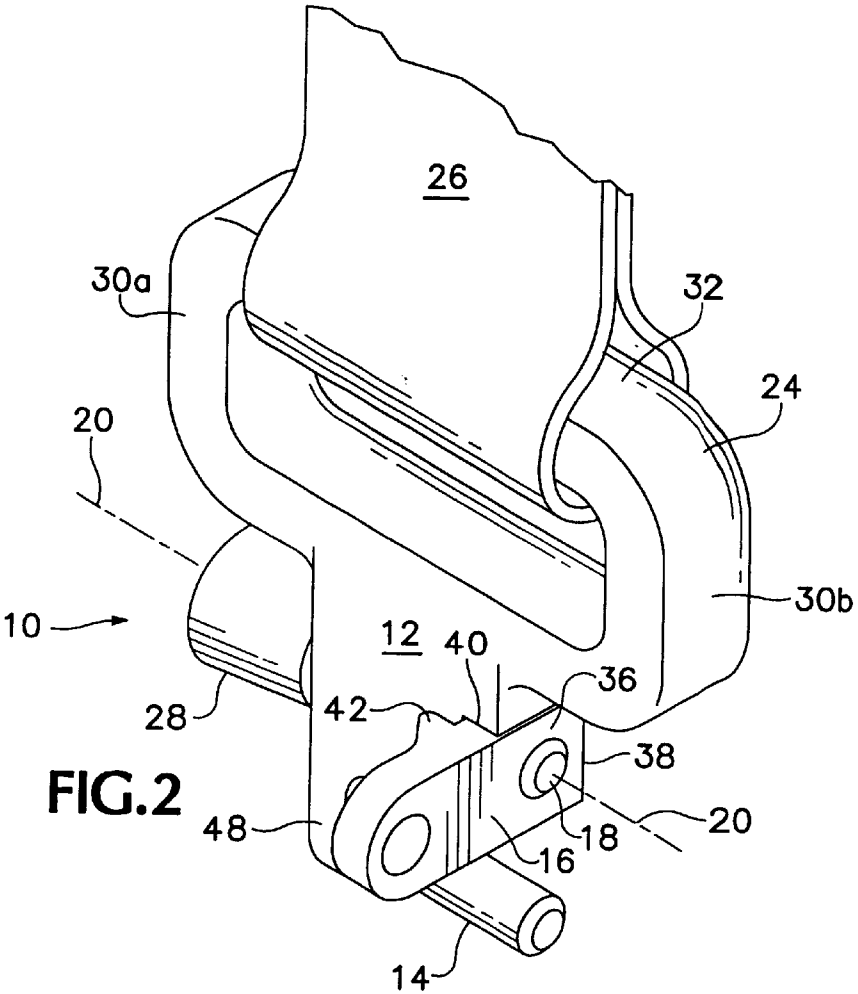
FIG. 2 shows the sling swivel of FIG. 1, but with the shift/swing gate in an open position so that the mounting pin is free to receive a swivel stud.

The shift/swing gate 16 interconnects with the tang 48 to secure the sling swivel 10 to a swivel stud when the pin 14 is received in the bore of the swivel stud. The shift/swing gate operates as follows. Gate 16 is joined at one end of a spring-biased plunger 18, whose biasing spring (not shown), urges the plunger 18 axially leftward as shown in FIGS. 1 and 2, together with the gate 16. The gate 16 is capable of being rotated about the axis 20 of plunger 18 from an open to a closed position when the plunger 18 is moved far enough to the right as shown in FIGS. 1 and 2. In the open position, the gate 16 is swung away from the mounting pin 14 so that the mounting pin 14 may receive or be removed from the bore of a swivel stud. In a closed position, the gate 16 engages the mounting pin 14 so that the mounting pin 14 may not be withdrawn from the bore. FIG. 1 shows the shift/swing gate in a closed position, while FIG. 2 shows the shift/swing gate in an open position and capable of receiving a bore from an external structure such as a swivel stud. The gate 16, through manipulation of the plunger 18, is thus adjustable between open and closed positions relative to the body 12 to enable mounting, demounting and securing of the swivel 10 relative to an external structure.

The swivel 10 includes a locking mechanism (not shown) interconnecting the sleeve 28 adjustably with the plunger 18 for locking the plunger positively and selectively against manipulation thereof to prevent the gate 16 from rotating from a closed to an open position. The position-changeable sleeve 28, and the locking mechanism used to place the swivel in locked and unlocked conditions, are more fully disclosed in Ives, U.S. Pat. No. 4,454,675, the disclosure of which is fully incorporated herein by reference. Alternatively, the present invention may be used with the sleeve and attendant locking mechanism disclosed in Ives, U.S. Pat. No. 5,067,267, the disclosure of which is also fully incorporated herein by reference. These locking mechanisms restrict movement of the plunger along its longitudinal axis, thus preventing the plunger from moving far enough away from the body 12 to allow the shift/swing gate 16 to become disengaged from the pin 14. While the locking mechanisms of Ives, U.S. Pat. No. 4,454,675 and Ives, U.S. Pat. No. 5,067,267 are preferred, other mechanical locking mechanisms that lock the gate in the closed position may be used with the present invention, so long as the locking mechanism is capable of withstanding extreme pull forces.

Figures 3, 4, 5, 6, 7:
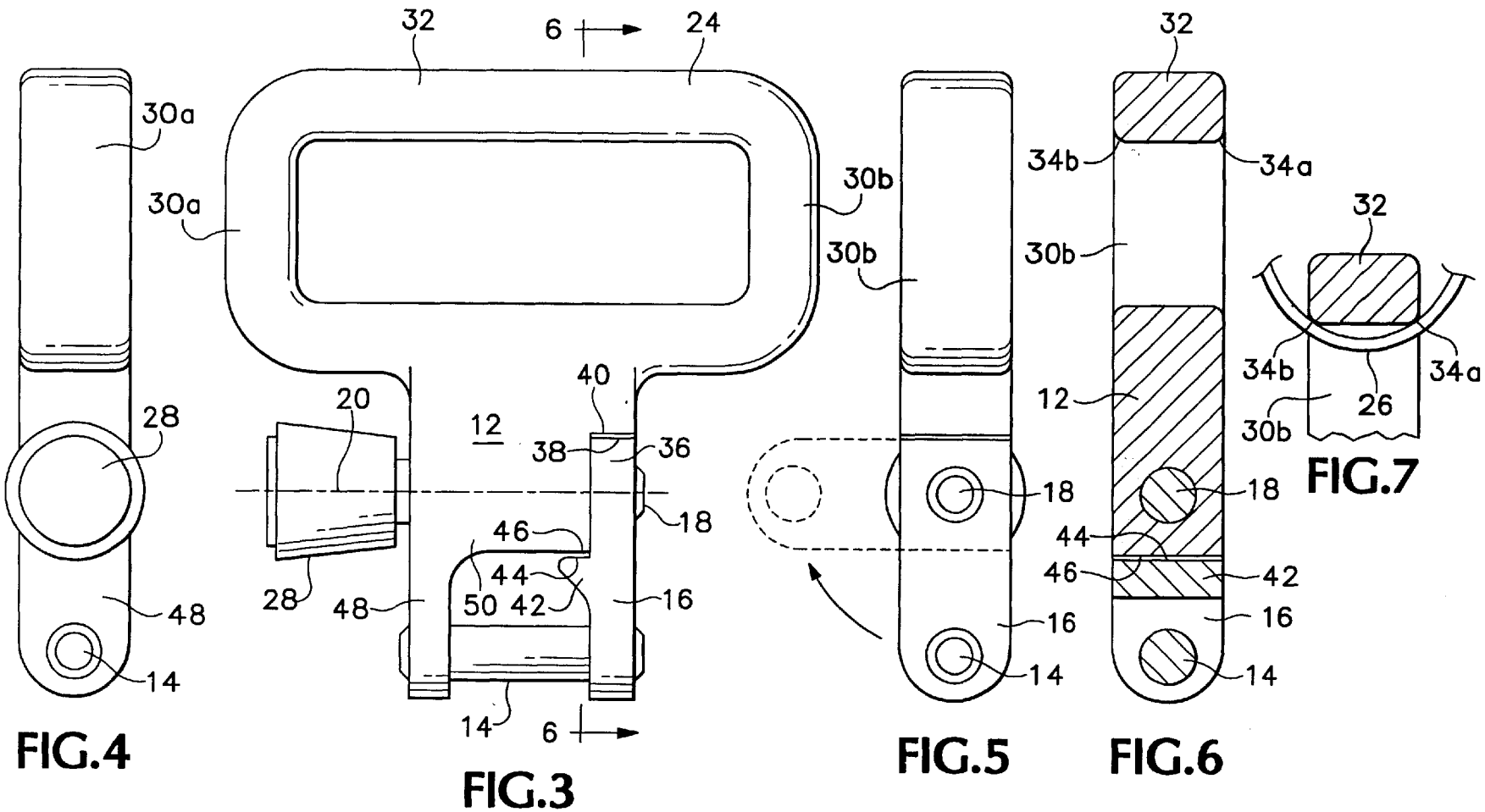
FIG. 3 shows a front view of the sling swivel of FIG. 1, without an attached sling.
FIG. 4 is a side view of the sling swivel of FIG. 1, showing the sleeve of a gate locking mechanism.
FIG. 5. is a side view from the opposite side shown in FIG. 4, and showing the shift/swing gate in the open position in phantom view.
FIG. 6 is a sectional view taken along the line 6—6 of FIG. 3.
FIG. 7 is a similar sectional view as in FIG. 6, but showing a sling engaging the front portion of the loop, and showing the loop in fragmentary view.

In a first independent aspect of the invention, the loop 24 includes a pair of opposed, substantially parallel side members 30*a* and 30*b*. By substantially parallel side members is meant that at least a major portion of the side members, and preferably more than 80 percent of the length of the side members, is straight and without curvature. The loop 24 is integrally formed with the body 12. That is, the loop 24 and the body 12 together are formed to be a single structure. Each portion of the loop 24 has a substantially rectangular cross-section as shown in FIG. 6. By substantially rectangular cross-section is meant that the cross-section has straight side walls, but may have curved corners, so long as the side walls are greater in length than the curved portions of the corners.

While not wishing to be bound by a particular theory, the present inventor believes that the substantially parallel side members, and the rectangular cross-section of the loop, each contribute to the enhanced strength of the swivel of the present invention. First, it is believed that by providing substantially parallel side members 30*a* and 30*b*, the pull force imparted by the sling 26 is transferred directly to the body 12, with little if any force being directed on the sides 30*a* and 30*b* toward the center of the loop opening. This is in contrast to swivels which have rounded loops with relatively large radii of curvature on the order of approximately ⅜ to ¼ inches, in which the pull force is transferred to the body through curved portions of the loop, and which consequently generate forces on the loop directed inwardly perpendicular to the pull force imparted by the sling. It is believed such forces cause curved loops to collapse inwardly in response to extreme pull forces. However, by utilizing substantially parallel side members 30*a* and 30*b* instead of curved side portions, the loop 24 of the present invention does not experience the same type of force directed inwardly against the side members 30*a* and 30*b* of the loop 24.

Second, the rectangular cross-section is also believed to contribute to the strength of the loop 24. Referring now to FIG. 7, when the sling 26 is pulled against the front portion 32 of the loop 24, the sling 26 pulls against the corners 34*a* and 34*b* of the front portion 32. Since the pull force is divided between the top and bottom of the loop 24, the force is more evenly distributed across the loop 24. In contrast, in loops having circular cross-sections, the sling contacts the loop at the center of the loop and therefore the pull force is concentrated at the center of the loop. By evenly distributing the pull force across the top and bottom of the loop 24, the loop 24 is capable of withstanding greater pull forces.

In addition, it is also important that the loop 24 be integrally formed with the swivel body 12. Forming an integral loop 24 and body 12 creates a much stronger connection than the mechanical connections of the prior art. Such an integral connection is capable of withstanding greater pull strengths, and is also more resistant to twisting forces imparted on the swivel 10.

Pull tests have confirmed the strength enhancing properties of the loop design of the present invention. A wire fabricated Boonie Packer swivel having a 1 inch wide loop and a loop cross-section of 0.023 sq. inches (rectangular) became deformed and inoperable at 478 lbs. of pull force. The shift/swing gate was no longer operable because of deformation of the wire. An injection molded Boonie Packer swivel having a 1 inch wide loop and a loop cross-section of 0.019 sq. inches (circular) became deformed at 487 lbs. of pull force. In contrast, a metal injection molded swivel of the present invention having a 1¼ inch wide loop and loop cross-section of 0.022 sq. inches withstood a pull force of 503 lbs. without any visible deformation. Because the loop cross-sections for each of these swivels was about the same, the strength improvement is a result of the geometry of the structure itself. In addition, the swivel of the present invention that was tested, having a 1¼ inch wide loop, would be expected to fail at lower pull forces than a comparable swivel having a 1 inch wide loop, given the greater width of the loop. Thus, the test results above demonstrate the superiority of the swivel of the present invention.

In another independent aspect of the invention, the shift/swing gate 16 has an additional locking surface which enhances the ability of the gate 16 to remain in the closed position in response to twisting forces. Referring now particularly to FIG. 3, the gate 16 has a novel wedge 42 that protrudes inwardly from the side of the gate 16 toward the tang 48. The wedge 42 has a top surface 44 that opposes a lower flat surface 46 of the body 12. The top surface 44 of the wedge 42 and lower surface 46 of the body 12 are preferably as close to each other as possible when the gate 16 is in the closed position, so that the gate 16 is prevented from rotating about the axis of the plunger 18 due to the interference between the opposing top surface 44 and lower surface 46.

In addition, like the prior art swivels, the gate 16 has an upper end 36 adjacent to the plunger 18. The upper end 36 has a top surface 38 that opposes a lower surface 40 of the body 12. In order to prevent the gate 16 from rotating from the closed position to the open position, the top surface 38 of the gate 16 is flat and directly opposes the lower flat surface of the body 40. The top surface 38 of the gate 16 and lower surface 40 of the body 12 are preferably as close to each other as possible when the gate 16 is in the closed position, so that the gate 16 is prevented from rotating about the axis of the plunger 18 due to the interference between the opposing top surface 38 and lower surface 40.

Thus, the swivel 10 has three locking features to prevent the gate 16 from becoming detached or disengaged from pin 14: the locking mechanism that limits movement of the plunger; the opposing surfaces of the wedge and the body; and the opposing surfaces of the gate and the body.

In addition, body 12 has a tang 48 extending from the body 12 to which the mounting pin 14 is attached. Because swivel studs are typically rounded, there is for most applications sufficient clearance above the mounting pin 14 to allow the tang 48 to have additional material at its upper end 50 where it connects to the body 12 to reinforce the tang 48. The tang 48 is also preferably as short as allowed for the desired application. This will depend on the particular style of mounting base or swivel stud with which the swivel will be used. Alternatively, while the embodiments described herein show the mounting pin 14 attached to the tang 48, the pin 14 could instead be connected to the gate 16 so that the pin 14 engages the tang 48 in the closed position.

The swivels 10 of the present invention are made as follows. The integral body 12 and loop 24 are injection molded from metal powder. It is believed that the rectangular cross-section of the loop 24 is preferable for injection molding, since this shape appears to be less susceptible to the formation of voids during the injection molding process. An exemplary material which may be used is a steel metal injection molding compound sold under the trade name MIM 4600, available from Carpenter Parmatech in Petaluma, Calif. Other equivalent materials could also be used. The metal injection molding process may be performed conventionally as is known to persons skilled in the art. The locking mechanism may be fabricated as described in Ives, U.S. Pat. No. 4,454,675 or Ives, U.S. Pat. No. 5,067,267. While injection metal molding is preferred, the swivel could be machined or made using other conventional metal fabrication techniques.

While the inventor has found that certain features of the present invention yield improved resistance to extreme pull strengths, nonetheless the features may be used alone or in combination. In addition, the arrangement, dimensions, combination of the various features, and the resulting overall appearance of the sling swivel, may be tailored to the aesthetic and ornamental needs of the designer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A quick-detachable sling swivel, comprising:

(a) a body having a first end and a tang located oppositely from said first end;

(b) a loop attached to said first end of said body;

(c) an elongate plunger mounted in said body and defining a plunger axis, said plunger movable axially between first and second positions with respect to said body;

(d) a shift/swing gate associated with said body through said plunger, said gate being rotatable when said plunger is in said second position, said gate being capable of interconnecting with said tang when said plunger is in said first position, and a locking mechanism for restricting movement of said plunger from said first to said second position;

(e) said loop having a pair of opposed, substantially parallel side members, said side members each having a portion substantially perpendicular to said plunger axis; and (f) wherein said gate includes a member protruding from a side of said gate toward said tang, said member having an upper flat surface that opposes a flat lower surface of said body when said gate is interconnected with said tang, said member interfering with rotation of said gate when said plunger is in said first position.

2. The swivel of claim 1 wherein a front member of said loop has a substantially rectangular cross-section.

3. The swivel of claim 1 wherein said side members each have a substantially rectangular cross-section.

4. The swivel of claim 2 wherein said gate includes a wedge protruding inwardly toward said tang, said wedge having an upper flat surface that opposes a flat lower surface of said body when said gate is interconnected with said tang.

5. The swivel of claim 1 wherein said gate has a top flat surface that opposes another flat lower surface of said body when said gate is interconnected with said tang.

6. The swivel of claim 1 wherein said body and said loop are formed by metal injection molding.

7. The swivel of claim 1 wherein said swivel is capable of withstanding at least 500 lbs. of pull force.

8. The swivel of claim 1 wherein said tang supports a mounting pin and said gate engages said mounting pin when said gate is interconnected with said tang.

9. A quick-detachable sling swivel, comprising:

(a) a body having a first end and a tang located oppositely from said first end;

(b) a loop attached to said first end of said body;

(c) an elongate plunger mounted in said body and defining a plunger axis, said plunger movable axially between first and second positions with respect to said body;

(d) a shift/swing gate associated with said body through said plunger, said gate being rotatable in said second position, said gate being capable of interconnecting with said tang when said plunger is in said first position, and a locking mechanism for restricting movement of said plunger from said first to said second position; and (e) said gate including a member protruding from a side of said gate toward said tang, said member having a flat upper surface that opposes a flat lower surface of said body when said gate is interconnected with said tang, said member interfering with rotation of said gate when said plunger is in said first position.

10. The swivel of claim 9 wherein said loop has a front member having a substantially rectangular cross-section.

11. The swivel of claim 9 wherein said loop has side members each having substantially rectangular cross-sections.

12. The swivel of claim 9 wherein said gate has an upper end having a flat top surface that opposes a flat lower surface of said body when said gate is interconnected with said tang.

13. The swivel of claim 9 wherein said body and said loop are integrally formed by metal injection molding.

14. The swivel of claim 9 wherein said swivel is capable of withstanding at least 500 lbs. of pull force.

15. The swivel of claim 9 wherein said tang supports a mounting pin and said gate engages said mounting pin when said gate is interconnected with said tang.

16. A quick-detachable sling swivel, comprising:

(a) a body having a first end and a tang located oppositely from said first end;

(b) a loop attached to said first end of said body;

(c) an elongate plunger mounted in said body and defining a plunger axis, said plunger movable axially between first and second positions with respect to said body;

(d) a shift/swing gate associated with said body through said plunger, said gate being rotatable in said second position, said gate being capable of interconnecting with said tang when said plunger is in said first position, and a locking mechanism for restricting movement of said plunger from said first to said second position;

(e) said body and said loop being an integral member; and (c) said swivel being capable of withstanding at least 500 lbs. of pull force.

17. The swivel of claim 16 wherein a front member of said loop has a substantially rectangular cross-section.

18. The swivel of claim 16 wherein said body and said loop are integrally formed by metal injection molding.

19. The swivel of claim 16 wherein said tang supports a mounting pin and said gate engages said mounting pin when said gate is interconnected with said tang.

20. The swivel of claim 16 wherein said loop has a pair of opposed substantially parallel side members.

21. The swivel of claim 20 wherein said side members have a rectangular cross section.

22. The swivel of claim 17 wherein said loop has a pair of parallel side members.

23. The swivel of claim 22 wherein said side members have a rectangular cross section.

* * * * *